US005628380A

United States Patent [19]

Matisi

[11] Patent Number: 5,628,380

[45] Date of Patent: May 13, 1997

[54] PORTABLE FIRE ESCAPE

[76] Inventor: Steve Matisi, 68-33 79th St., Middle Village, N.Y. 11379

[21] Appl. No.: 450,912

[22] Filed: May 26, 1995

[51] Int. Cl.[6] ..... A62B 1/06; E06C 1/52; E06C 5/26

[52] U.S. Cl. ..... 182/70; 182/196; 182/206

[58] Field of Search ..... 182/70, 206, 196, 182/197, 198

[56] References Cited

U.S. PATENT DOCUMENTS

| | | | |
|---|---|---|---|
| 1,723,129 | 8/1929 | Blaufeld | 182/70 |
| 3,385,399 | 5/1968 | Burt | 182/70 |
| 3,727,724 | 4/1973 | Gilbert et al. | 182/206 |
| 3,907,064 | 9/1975 | Svalberg et al. | 182/206 |
| 4,079,811 | 3/1978 | Driskell | 182/70 |
| 4,157,130 | 6/1979 | Aberer . | |
| 4,243,121 | 1/1981 | Kiss et al. . | |
| 4,531,612 | 7/1985 | Sandor . | |
| 4,751,982 | 6/1988 | Wolfe | 182/206 |
| 5,467,841 | 11/1995 | Krumal | 182/70 |
| 5,499,692 | 3/1996 | Brook | 182/206 |

FOREIGN PATENT DOCUMENTS

| | | | |
|---|---|---|---|
| 5071284 | 3/1993 | Japan | 182/70 |
| 5068715 | 3/1993 | Japan | 182/70 |
| 1476098 | 4/1989 | U.S.S.R. | 182/70 |
| 2204629 | 11/1988 | United Kingdom | 182/70 |
| 2230813 | 10/1990 | United Kingdom | 182/196 |

*Primary Examiner*—Daniel P. Stodola
*Assistant Examiner*—Matthew A. Kaness
*Attorney, Agent, or Firm*—Michael I. Kroll

[57] ABSTRACT

A portable fire escape comprising a framework. A structure is for mounting the framework across an opened window internally within a building adjacent a window sill. An elongated extendable flexible ladder is provided. Paraphernalia is for attaching a top end of the flexible ladder to the framework. The flexible ladder can hang down externally against the building to the ground, to allow a person to exit through the opened window of the building during a fire.

8 Claims, 2 Drawing Sheets

Fig. 3
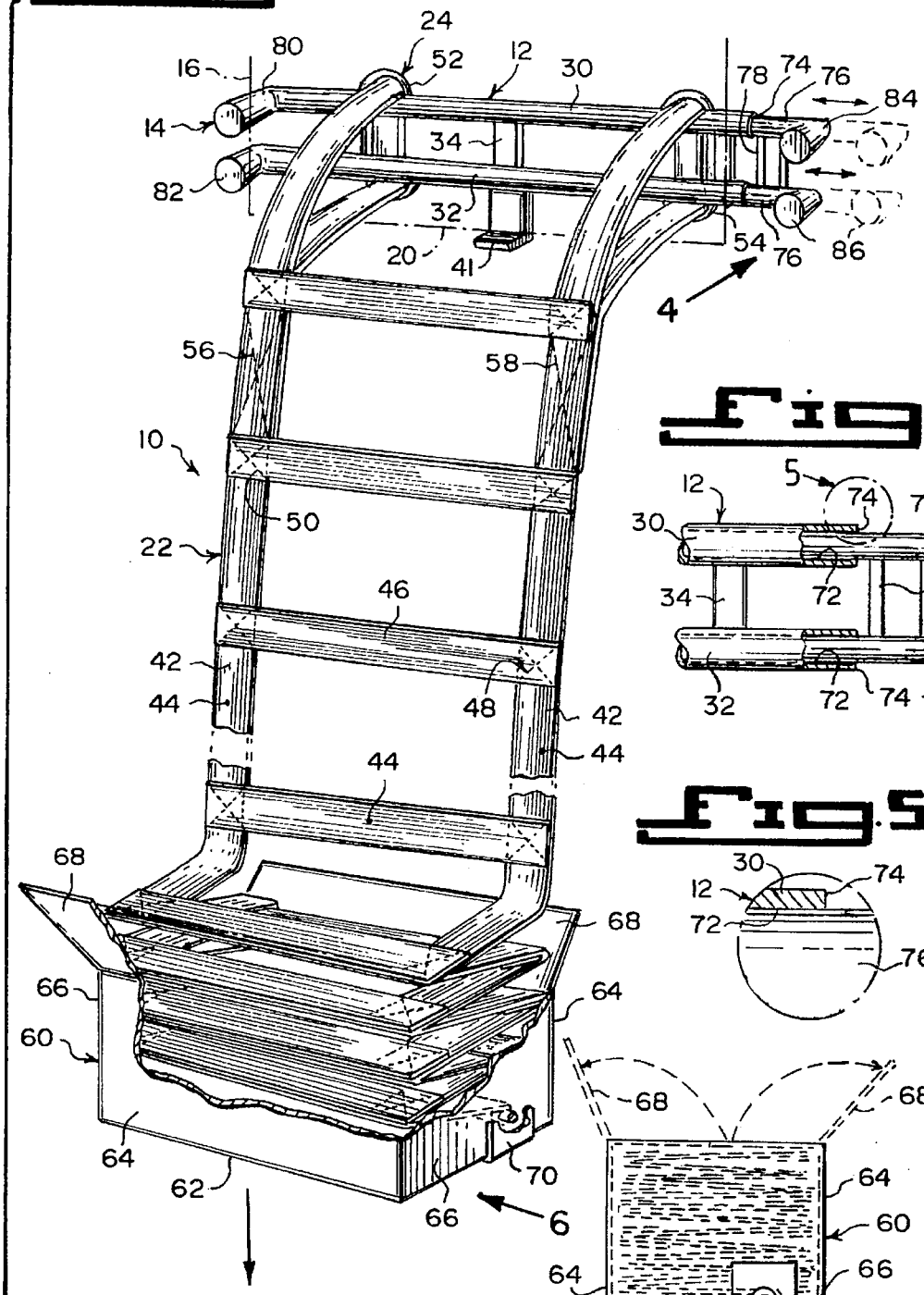
Fig. 4
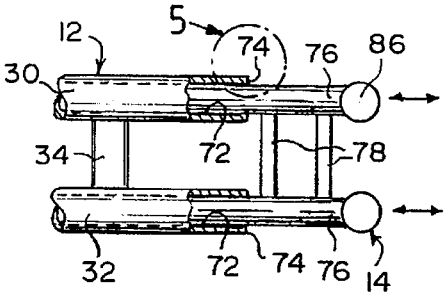
Fig. 5
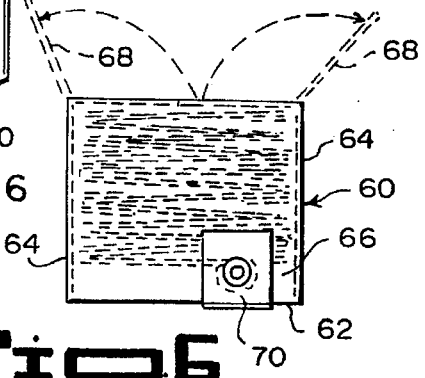
Fig. 6

PORTABLE FIRE ESCAPE

BACKGROUND OF THE INVENTION

1. Field of the Invention

The instant invention relates generally to safety ladders and more specifically it relates to a portable fire escape.

2. Description of the Prior Art

Numerous safety ladders have been provided in prior art. For example, U.S. Pat. Nos. 4,157,130 to Aberer; U.S. Pat. Nos. 4,243,121 to Kiss et al.; U.S. Pat. No. 4,531,612 to Sandor and U.S. Pat. No. 4,751,982 to Wolfe all are illustrative of such prior art. While these units may be suitable for the particular purpose to which they address, they would not be as suitable for the purposes of the present invention as heretofore described. The following discusses the prior art identified above.

A fire ladder includes as opposite sides a pair of elongate flexible cables in the form of interwoven strands of wire. Hollow tubes flattened and scored on their upper surfaces extend rigidly between the cables to provide the ladder rungs. The rungs have initially open ends into which looped portions of the cables are inserted. One side wall of the rung is then crimped inwardly and pressed against the opposite wall, to firmly clamp the cable within the rung. Hook-like arms secured to the ends of the cables serve to suspend the ladder from a window sill and may be folded by means of a hinge structure to a collapsed storage position occupying little space. A spring located within the hinge arms maintains the hook-like support arms spaced apart during use, while stops prevent the arms from pivoting excessively.

There is provided the combination of a frame and a collapsible ladder. The frame defines two spaced-apart horizontal passages in which catch elements are mounted. Resilient means urge the catch elements toward each other, and manual thumbscrew means are provided, to pull the catch elements away from each other. A collapsible ladder has attachment means at the top by which it can be anchored, and the ladder also includes a containment means constituted by the bottom rung and two upstanding side members which register with all of the remaining rungs. The upstanding side members have openings at the top into which the catch members extend when in their innermost positions. Manual release is possible by which the side, members become disengaged from the frame, thus allowing the web ladder to fall into a position of use.

The invention relates to a portable emergency fire escape ladder, comprising a large double hook adapted to fit over a window ledge. Tubular steps are suspended by means of galvanized steel cables. The steps are secured on the suspension cables by means of pressed steel rings. The tubular steps are slightly larger in diameter at one end than the other, allowing the steps to joint together to form a pole. There is a connecting rod under the double hook, for the attachment of the top tubular step in the pole position. The double hook has a curvature at the lower end in order that the tubular steps may be spaced a distance from the wall, to allow room for the person's foot. The double hook is provided with a pull cable which is strung through the frame of the double hook, to the end pieces, so that pulling on the cable will release the double hook from the window ledge, allowing a person down the wall.

A foldable ladder having a plurality of rigid steps. Inwardly folding arms are pivotably secured to the steps, so as to be rigid in use by and capable of being folding for storage.

SUMMARY OF THE INVENTION

A primary object of the present invention is to provide a portable fire escape that will overcome the shortcomings of the prior art devices.

Another object is to provide a portable fire escape having an adjustable framework to engage the interior sides of an opened window at a sill in a building and an elongated extendable flexible ladder attached at a top end to the framework, so that a person can exit through the opened window in the building and down the flexible ladder during a fire or other emergency.

An additional object is to provide a portable fire escape in which the flexible ladder is stored within a box when not in use, so that during the fire or other emergency, the box can be dropped out of the opened window, to allow the flexible ladder to unfold out of the box and extend down the exterior side of the building to the ground.

A further object is to provide a portable fire escape that is simple and easy to use.

A still further object is to provide a portable fire escape that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is an enlarged perspective view of the instant invention with parts broken away, showing the flexible ladder unfolding from the storage box.

FIG. 4 is an elevational view taken in the direction of arrow 4 in FIG. 3, with parts broken away and in section, showing the sliding adjustment bars in greater detail.

FIG. 5 is an enlarged view as indicated by arrow 5 in FIG. 4.

FIG. 6 is a side elevational view taken in the direction of arrow 6 in FIG. 3 of the storage box.

Similar reference characters denote corresponding features consistently throughout the attached drawings.

DETAILED DESCRIPTION OF THE PREFERRED EMBODIMENTS

Figure 1:
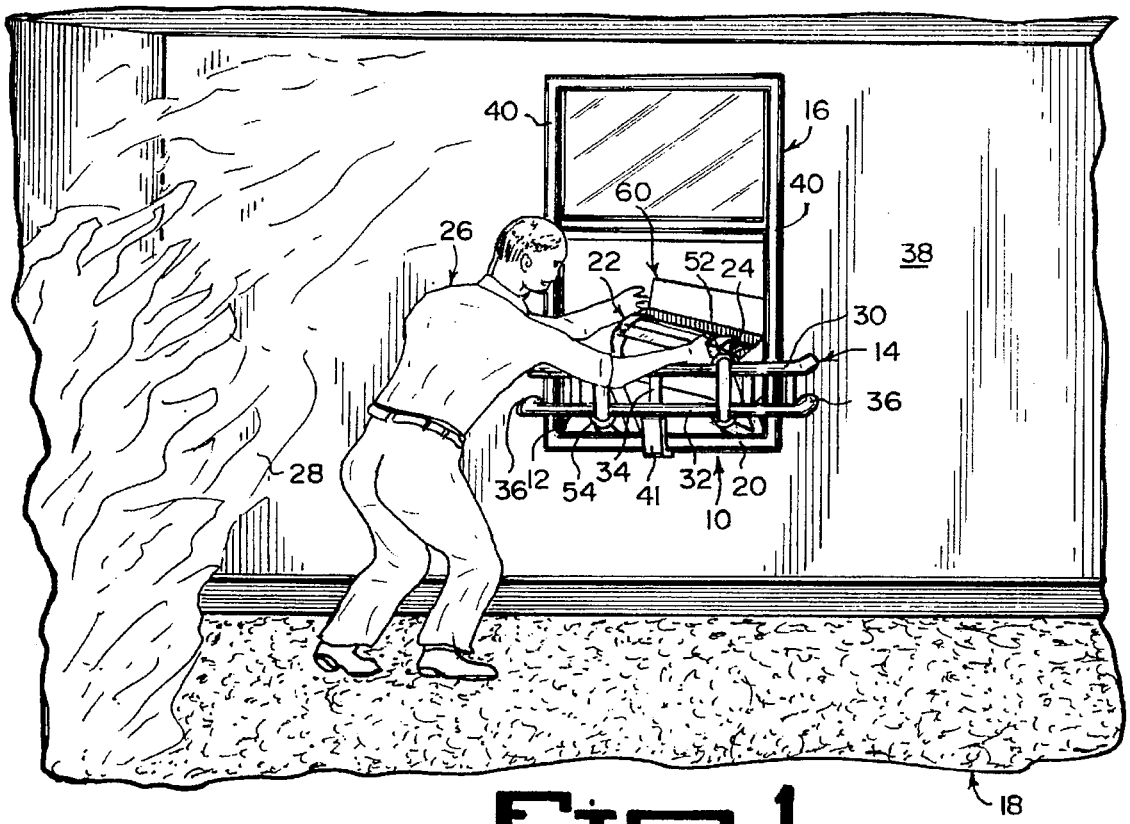
FIG. 1 is a view of an interior of a building during a fire, showing the instant invention being deployed through an opened window.
Figure 2:
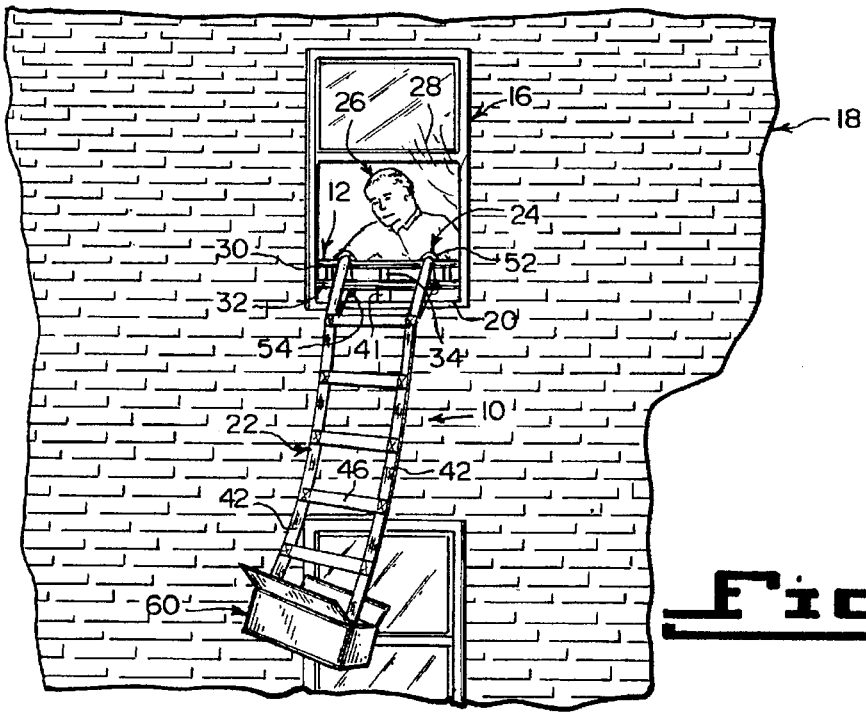
FIG. 2 is a view of the exterior of the building during a fire, showing the instant invention being deployed through the opened window.

Turning now descriptively to the drawings, in which similar reference characters denote similar elements throughout the several views, FIGS. 1 through 6 illustrate a portable fire escape 10, comprising a framework 12. A structure 14 is for mounting the framework 12 across an opened window 16 internally within a building 18 adjacent a window sill 20. An elongated extendable flexible ladder 22 is provided. Paraphernalia 24 is for attaching a top end of the flexible ladder 22 to the framework 12. The flexible ladder 22 can hang down externally against the building 18 to the ground, to allow a person 26 to exit through the opened window 16 of the building 18 during a fire 28.

The framework 12 includes a pair of substantially horizontal retainer rods 30, 32 being narrowly spaced apart and generally wider than the opened window 16. A plurality of substantially vertical crossbars 34 are spaced apart and affixed between the retainer rods 30, 32.

The mounting structure 14, as shown in FIG. 1, consists of each retainer rod 30, 32 having opposite ends bent at a right angle to form a foot 36, to bear against an internal wall 38 of the building 18 adjacent an opposite side jamb 40 of the opened window 16. The mounting structure 14 further includes an L-shaped bracket 41 extending downwardly from the lower retainer rod 32, to engage with the window sill 20.

The flexible ladder 22 consists of a pair of side rails 42, in which each side rail 42 is made out of a webbing material 44. A plurality of steps 46 are provided, in which each step 46 is made out of the webbing material 44. A component 48 is for securing an overlapped end of each step 46 to one side rail 42. The securing component 48 is square cross stitching 50 on each overlapped end of each step 46 with one side rail 42.

The attaching paraphernalia 24 includes a first pair of top loops 52 spaced apart, affixed to and extending upwardly on the upper retainer rod 30. A second pair of bottom loops 54 are spaced apart, affixed to and extends downwardly on the lower retainer rod 32. A top segment of each side rail 42, which extends beyond the uppermost step 46 can pass through one top loop 52 and one bottom loop 54. An element 56 is for fastening each top segment of each side rail 42 back against the respective side rail 42 between the uppermost step 46 and the step 46 directly below the uppermost step 46. The fastening element 56 is rectangular cross stitching 58 on each side rail 42 between the uppermost step 46 and the step 46 directly below the uppermost step.

A storage box 60 is for retaining the flexible ladder 22 therein in a folded state. When the flexible ladder 22 hangs down from the opened window 16, the storage box 60 can be opened and then dropped out of the opened window 16, to deploy the flexible ladder 22 therefrom. The storage box 60 includes a bottom wall 62 with a pair of side walls 64 extending upwardly from the bottom wall 62. A pair of end walls 66 extend upwardly from the bottom wall 62, to form a compartment 68 therein to store the flexible ladder 22 therein in the folded state.

The storage box 60 further includes a pair of flip top flaps 68 hinged thereto. The flip top flaps 68 can cover the storage box 60 when not in use and can be manually opened when the flexible ladder 22 is deployed therefrom. The storage box 60 also contains a generally weighted U-shaped bracket 70 clamped against the bottom wall 62 and the end walls 66. A bottom end of the flexible ladder 22 can be connected through the end walls 66 to the U-shaped bracket 70.

The framework 12, as shown in FIGS. 3, 4 and 5, is adjustable in length and includes each retainer rod 30, 32 having an elongated bore 72 extending from a first end 74. A pair of substantially horizontal slider rods 76 are provided. A pair of vertical connecting bars 78 are spaced apart and affixed between the slider rods 74. The slider rods 76 can fit into the bores 72 from the first ends 74 of the retainer rods 30, 32 and be adjusted thereto, to compensate for different sized windows 16.

The mounting structure 14 in FIGS. 3 and 4, consists of each retainer rod 30, 32 having a second end 80 bent at a right angle to form a foot 82 to bear against the internal wall 38 of the building 18 adjacent the side jamb 40 of the opened window 16. Each slider rod 76 has a free end 84 bent at a right angle to form a foot 86 to bear against the internal wall 38 of the building 18 adjacent an opposite side jamb 40 of the opended window 16.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A portable fire escape comprising:

a) a framework forming a top portion of said fire escape;

b) said framework including means for mounting said framework across an opened window completely within a building comprising substantially horizontal upper and lower retainer rods extending past both sides of said window, each retainer rod having opposite ends bent at right angle to form a foot bearing against and unattached to an internal wall of the building adjacent an opposite sides of the opened window;

c) an elongated extendable flexible ladder with rungs substantially parallel to said retainer rods;

d) means for attaching one end of said flexible ladder to said framework permitting said flexible ladder when deployed to hang down externally against the building to the ground to allow a person to exit through the opened window of the building during a fire;

e) box means for storing said flexible ladder in a folded condition and incorporating bracket means to attach the second end of said flexible ladder to said box means permitting said box means containing said flexible ladder to be stored within said building and thrown out of said window during a fire and allowing said flexible ladder to deploy while said box means falls to the ground.

2. A portable fire escape as recited in claim 1, wherein said window has a sill and said mounting means further includes an L-shaped bracket extending downwardly from said lower retainer rod to engage with the window sill.

3. A portable fire escape as recited in claims 2, wherein said flexible ladder includes:

a) a pair of side rails, in which each said side rail is made out of a webbing material;

b) a plurality of steps, in which each said step is made out of a webbing material; and c) means for securing an overlapped end of each said step to each said side rail.

4. A portable fire escape as recited in claim 3, wherein said securing means is square cross stitching on each overlapped end of each said step with one said side rail.

5. A portable fire escape as recited in claim 2, wherein said box means has bottom and end walls and said bracket means includes a weighted U-shaped bracket member clamped against said bottom and end walls.

6. A portable fire escape as recited in claim 5, wherein said framework is adjustable in length and includes:

a) each said retainer rod having an elongated bore extending from a first end;

b) a pair of substantially horizontal slider rods; and c) a pair of vertical connector bars spaced apart and affixed between said slider rods, so that said slider rods can fit into said bores from said first ends of said retainer rods and be adjusted thereto, to compensate for different sized windows.

7. A portable fire escape as recited in claim 1, wherein said attaching means includes:

a) a first pair of top loops spaced apart, affixed to and extending upwardly on said upper retainer rod;

b) a second pair of bottom loops spaced apart, affixed to and extending downwardly on said lower retainer rod, so that a top segment of each said side rail which extends beyond said uppermost step can pass through one said top loop and one said bottom loop; and c) means for fastening each top segment of each said side rail back against said respective side rail between said uppermost step and said step directly below said uppermost step.

8. A portable fire escape, as recited in claim 7, wherein said fastening means is rectangular cross stitching on each said side rail between said uppermost step and said step directly below said uppermost step.

* * * * *